US006715951B2

(12) United States Patent
Gueret

(10) Patent No.: US 6,715,951 B2
(45) Date of Patent: Apr. 6, 2004

(54) UNIT FOR APPLYING AT LEAST ONE PRODUCT

(75) Inventor: Jean-Louis H. Gueret, Paris (FR)

(73) Assignee: L'oreal S.A., Paris (FR)

( * ) Notice: Subject to any disclaimer, the term of this patent is extended or adjusted under 35 U.S.C. 154(b) by 0 days.

(21) Appl. No.: 10/126,589

(22) Filed: Apr. 22, 2002

(65) Prior Publication Data

US 2002/0172541 A1 Nov. 21, 2002

(30) Foreign Application Priority Data

Apr. 20, 2001 (FR) ..... 01 05390

(51) Int. Cl.[7] ..... A45D 33/00
(52) U.S. Cl. ..... 401/130; 401/126
(58) Field of Search ..... 401/130, 126, 401/127, 123, 118, 261, 262

(56) References Cited

U.S. PATENT DOCUMENTS

| | | | |
|---|---|---|---|
| 1,021,709 | A | 3/1912 | Snow |
| 1,056,457 | A | 3/1913 | Schloss |
| 1,063,484 | A | 6/1913 | Weismantel |
| 1,172,293 | A | 2/1916 | Kohlhepp |
| 1,315,305 | A | 9/1919 | Hegland |
| 1,450,386 | A | 3/1923 | Regan |
| 1,918,215 | A | 6/1933 | Runnels |
| 2,069,048 | A | 1/1937 | Rehberger |
| 2,554,489 | A | 5/1951 | Crane |
| 2,659,919 | A | 11/1953 | McCabe et al. |
| 2,691,184 | A | 10/1954 | Miller et al. |
| 2,837,756 | A | 6/1958 | Barlow et al. |
| 2,841,809 | A | 7/1958 | Oliver |
| 2,853,727 | A | 9/1958 | Nadai |

(List continued on next page.)

FOREIGN PATENT DOCUMENTS

| | | |
|---|---|---|
| CH | 406 544 | 8/1966 |
| DE | 938 658 | 2/1956 |
| DE | 1 816 825 U | 8/1960 |
| DE | 2 132 433 | 1/1973 |
| DE | 35 25 418 A1 | 2/1988 |

(List continued on next page.)

OTHER PUBLICATIONS

Co–pending Application No. 09/666,450; Title: Packaging and Application Device Inventor: Jean–Louis H. Gueret U.S. Filing Date: Sep. 21, 2000 Preliminary Amendment Filed: Sep. 21, 2000; Supplemental Preliminary Amendent Filed: Oct. 31, 2000; and Supplemental Preliminary Amendment and Response Filed: Oct. 24, 2001.

(List continued on next page.)

*Primary Examiner*—David J. Walczak
(74) *Attorney, Agent, or Firm*—Finnegan, Henderson, Farabow, Garrett & Dunner, L..L.P.

(57) ABSTRACT

A unit for applying at least one product comprises a first housing configured to contain at least one product, a second housing configured to be at least temporarily in flow communication with the first housing, a removable closure element configured to substantially seal the opening of the second housing, and an applicator member removably disposed in the second housing. The second housing comprises an opening defined by an edge. The applicator member comprises an application surface, a first portion adjacent to the application surface, and at least one second portion separated from the application surface by the first portion. The at least one second portion is configured to have a greater compressibility than the first portion such that the applicator member at least partially absorbs pressing force exerted on the application surface during application of the at least one product.

208 Claims, 7 Drawing Sheets

U.S. PATENT DOCUMENTS

| | | | | | |
|---|---|---|---|---|---|
| 2,896,236 | A | | 7/1959 | Bartkewitz | |
| 2,975,464 | A | | 3/1961 | Schultz | |
| 3,084,375 | A | | 4/1963 | Schwartzman | |
| 3,100,314 | A | | 8/1963 | Smith | |
| 3,113,336 | A | | 12/1963 | Langnickel | |
| 3,129,452 | A | | 4/1964 | Schwartzman | |
| 3,132,370 | A | | 5/1964 | Capezzuto | |
| 3,133,309 | A | | 5/1964 | Miles | |
| 3,266,079 | A | | 8/1966 | Schwartzman | |
| 3,444,808 | A | | 5/1969 | Schwatrzman | |
| 3,456,650 | A | | 7/1969 | Schwartzman | |
| 3,456,851 | A | | 7/1969 | Mattes et al. | |
| 3,463,597 | A | | 8/1969 | Wakai | |
| 3,592,365 | A | | 7/1971 | Schwartzmann | |
| 3,601,287 | A | | 8/1971 | Schwartzman | |
| 3,661,468 | A | | 5/1972 | Schwartzman | |
| 3,818,911 | A | | 6/1974 | Fournier | |
| 3,871,390 | A | * | 3/1975 | Spatz | 132/293 |
| 4,225,253 | A | | 9/1980 | Fraleigh | |
| 4,693,623 | A | | 9/1987 | Schwartzman | |
| 4,925,327 | A | | 5/1990 | Wirt | |
| 4,974,981 | A | | 12/1990 | Bennett | |
| 5,082,386 | A | | 1/1992 | Hironaka et al. | |
| 5,163,767 | A | | 11/1992 | Lucas | |
| 5,492,426 | A | | 2/1996 | Gueret | |
| 5,636,931 | A | | 6/1997 | Gueret | |
| 5,904,151 | A | | 5/1999 | Gueret | |
| 5,945,076 | A | | 8/1999 | Leonard et al. | |
| 6,004,056 | A | | 12/1999 | De Laforcade | |
| 6,386,781 | B1 | | 5/2002 | Gueret | |
| 6,447,191 | B1 | * | 9/2002 | Vasas | 401/7 |

FOREIGN PATENT DOCUMENTS

| | | |
|---|---|---|
| EP | 0 390 922 A1 | 10/1980 |
| EP | 0 163 189 | 12/1985 |
| EP | 0 416 185 | 3/1991 |
| EP | 0 612 488 | 8/1994 |
| EP | 0 688 516 | 12/1995 |
| EP | 0 855 177 | 7/1998 |
| EP | 0 872 193 A1 | 10/1998 |
| EP | 1 086 904 | 3/2001 |
| EP | 1 094 011 | 4/2001 |
| FR | 2 800 041 | 4/2001 |
| GB | 403219 | 12/1933 |
| GB | 1158412 | 7/1969 |
| WO | WO 98/39991 | 12/1998 |

OTHER PUBLICATIONS

Co–pending Application No. 09/968,988; Title: Device and Method for Packaging and Applying a Substance Inventor: Jean–Louis H. Gueret U.S. Filing Date: Oct. 3, 2001.

English language translation of CH 406 544.

English language Derwent Abstract of EP 0 612 488, Aug. 31, 1994.

English language Derwent Abstract of EP 0 688 516, Dec. 27, 1995.

English language Derwent Abstract of EP 1 094 011, Apr. 25, 2001.

English language Derwent Abstract of EP 1 086 904, Mar. 28, 2001.

Copy of U.S. patent application No. 09/691,944, filed Oct. 20, 2000, entitled "Applicator Device for Applying a Liquid Product "Attorney Dockett No. 05725.0776–00000.

English–Language abstract of DE 36 25 418 A1, Feb. 4, 1988.

English–Language abstract of EP 0 872 193 A1, Oct. 21, 1988.

English–Language abstract of WO 98/39991, Sep. 17,1988.

* cited by examiner

X
D
50
51
52
410
h
H
41
49
40
44
P
45
10
31
32
33
30
23
60
P
21
20
22
24

UNIT FOR APPLYING AT LEAST ONE PRODUCT

The present invention relates to a unit for applying at least one product. The at least one product may be chosen from cosmetic products and care products. Further, the at least one product may be in the form of one of a powder and a fluid. Examples of products that may be used may include lip make-up, foundation, blush, mascara, eye shadow, eye liner, and nail varnish.

Some conventional cosmetic product applicators are equipped with a foam member attached to a cap. Such applicators may be enclosed in a sealed space to preserve them from any contamination or evaporation. The applicators may be compressed in the sealed space. When this type of applicator is to be used for full-face applications or, alternatively, for applications to the body, a foam member having a larger diameter may be needed. Use is often made of high density foams with small cells which have a significant ability to retain the product by capillarity. High density foams provide a relatively firm foam member having a high density and a large diameter. Furthermore, because of their high rigidity, it may be difficult for such foams to conform to the various reliefs of the surface to which the product is applied. Moreover, these foams, which are often hydrophilic, and which contain moisture absorbers, have a tendency to swell upon contact with the product and to rub against the edges of the walls of the space in which they are housed. It thus may become difficult to re-introduce the applicator member into its housing because of the excessive resistance.

One of the aspects of the invention relates to a unit for applying at least one product that may allow cosmetic products and care products to be applied gently.

Another aspect of the invention relates to a unit for applying at least one product that may be able to adapt to various reliefs of the surface to which the product is applied.

A further aspect of the invention relates to a unit for applying at least one product that may be easily introduced into a sealed housing.

It should be understood that the invention could be practiced without one or more of the aspects discussed herein. Furthermore, it should be understood that all embodiments discussed herein are exemplary regardless of whether they are referred to as "exemplary" embodiments. It should also be understood that features associated with different embodiments described herein may be combined to form any number of additional embodiments.

In an exemplary embodiment, a unit for applying at least one product may comprise a first housing configured to contain at least one product, a second housing configured to be at least temporarily in flow communication with the first housing, a removable closure element configured to substantially seal the opening of the second housing, and an applicator member removably disposed in the second housing. The second housing may comprise an opening defined by an edge. The applicator member may comprise an application surface, a first portion adjacent to the application surface, and at least one second portion separated from the application surface by the first portion. The at least one second portion may be configured to have a greater compressibility than the first portion such that the applicator member at least partially absorbs pressing force exerted on the application surface during application of the at least one product. The at least one second portion of the applicator member may absorb at least substantially the pressing force.

As used herein, the "substantial seal" imparted by the closure element may limit or prevent product in the second housing from passing to the exterior of the unit via the opening of the second housing under normal use conditions. In one embodiment, the "substantial seal" may limit or prevent passage of air into the second housing under normal use conditions, but other embodiments are possible without such air sealing. It should be understood that the removable closure element could be configured in a variety of different ways. For example, the removable closure could abut the edge defining the opening. Alternatively (or additionally), in some embodiments, the closure element could abut an interior of the second housing and/or an exterior of the second housing.

The "application surface", as used herein, may be any surface of the applicator member intended to apply product. For example, the application surface may be configured in the form of an exterior surface arranged to apply product to skin, nails, or hair.

In another exemplary embodiment, the at least one second portion may be configured to have a greater compressibility than the first portion such that the application surface pivots in response to pressing force exerted on the application surface during application of the at least one product. The application surface may pivot at least at the at least one second portion of the applicator member.

In a further exemplary embodiment, the at least one second portion may be configured to have a greater compressibility than the first portion such that the applicator member flexes in response to pressing force exerted on the application surface during application of the at least one product. Additionally, the at least one second portion of the applicator member may flex in response to pressing force exerted on the application surface during application of the at least one product. Further, flexing of the applicator member may occur at least substantially at the at least one second portion of the applicator member.

In some embodiments, by virtue of the configuration of the applicator member comprising at least one second portion that may have a greater compressibility than the first portion, the pressing force exerted on the applicator member when the user applies the product to her skin, for example, may be at least in part absorbed. This may provide a unit that has a flexibility that allows relatively gentle application to the surface that is to be treated.

In some examples, the second portion may be configured in such a way as to encourage a specific compression of the applicator member. For example, by arranging the more compressible portion on one side of the applicator member, the first part of the applicator member and its application surface may be made to pivot with respect to an axis of the applicator member so that the application surface adapts to the relief of the surface receiving product application with an angle different from the angle at which the user is holding the applicator member and using it to apply product.

For some embodiments, the presence of the at least one second portion having a greater compressibility than the first portion may make it easier for the applicator member to be re-introduced into its housing by limiting the friction that the applicator member may have against the internal walls of the housing when, for example, the diameter of the applicator member is equal to or greater than that of the housing.

According to an aspect of the invention, the first portion of the applicator member may comprise a compressible material. The first portion of the applicator member may comprise at least one of an open-cell foam, a semi-open-cell foam, and a frit comprising a flexible material. The at least one of an open-cell foam and a semi-open-cell foam may comprise at least one of polyurethane, polyethylene, polyvinyl chloride, polyester, polyether, polyethylene-vinyl acetate, polyvinyl acetate foam, natural foam rubber, and synthetic foam rubber. In addition, the flexible material may be chosen from elastomers, thermoplastic elastomers, polyvinyl chlorides, and polyethylene-vinyl acetates.

In an exemplary embodiment, at least a part of the at least one second portion of the applicator member may comprise the same material as the first portion of the applicator member. Further, the at least a part of the at least one second portion of the applicator member may have a cross-sectional area over at least part of its axial height smaller than a cross-sectional area of the first portion of the applicator member.

There are a number of many different possible embodiments of the second portion of the applicator member.

In one exemplary embodiment, the at least one second portion of the applicator member may comprise at least one groove in a lateral surface of the applicator member. The at least one groove may be formed over at least part of a periphery of the applicator member. The at least one groove may have a non-circular shape.

In another exemplary embodiment, the at least one groove may be oriented at least partially in a plane transverse to a longitudinal axis of the applicator member. The plane may be perpendicular to the longitudinal axis of the applicator member. Alternatively, the plane may be inclined with respect to the longitudinal axis of the applicator member.

In a further exemplary embodiment, the at least one groove may have a cross-section transverse to the plane in which it is oriented. The cross-section may comprise one of a C-shape, a U-shape with a square bottom, a U-shape with a rounded bottom, and a V-shape.

In a still further exemplary embodiment, the at least one groove may comprise a plurality of grooves.

According to an exemplary embodiment, in the absence of force exerted on the application surface, the grooves may have substantially the same axial height. Alternatively, in the absence of force exerted on the application surface, at least one of the grooves may have a non-constant axial height.

According to a further exemplary embodiment, in the absence of force exerted on the application surface, the grooves may be spaced apart substantially evenly. Alternatively, in the absence of force exerted on the application surface, the grooves may be spaced apart unevenly.

In a still further exemplary embodiment, the grooves may be increasingly spaced apart as they lie further away from the application surface of the applicator member. That may make it possible to increase the flexibility of the applicator member gradually. Optionally, the grooves may have a different depth.

In one exemplary embodiment, the plurality of grooves may comprise at least three grooves. Optionally, a space between two successive grooves may be greater than the axial height of each of the two successive grooves.

In a further exemplary embodiment, the at least one second portion of the applicator member may comprise at least one substantially axial slot. The at least one substantially axial slot may comprise a plurality of slots spaced laterally across the applicator member. Optionally, the slots may be spaced apart substantially evenly.

In another exemplary embodiment, the second portion may comprise both grooves and slots.

In a still further exemplary embodiment, the first portion of the applicator member may comprise a first material and the second portion of the applicator member may comprise a second material different from the first material. The applicator member comprising at least two different materials may be obtained, for example, by two-shot injection molding.

In another exemplary embodiment, the first portion of the applicator member may comprise a first material and the second portion of the applicator member may comprise a second material having a greater compressibility than the first material.

According to a further exemplary embodiment, the at least one second portion of the applicator member may comprise at least one of an open-cell foam and a semi-open-cell foam. The at least one of an open-cell foam and a semi-open-cell foam may comprise at least one of polyurethane, polyethylene, polyvinyl chloride, polyester, polyether, polyethylene-vinyl acetate, polyvinyl acetate foam, natural foam rubber, and synthetic foam rubber.

In a still further exemplary embodiment, the applicator member may comprise at least two concentric blocks made of different materials. The materials may have different compressibility and/or density. The concentric blocks may have the same axial height or may have different axial heights.

In another exemplary embodiment, the at least one second portion of the applicator member may comprise a spring. The spring may be formed from a material chosen from metals and plastics. Other materials may also be used.

In yet another exemplary embodiment, the at least one second portion of the applicator member may define a central cavity. By choosing the dimensions of the cavity it may be possible to adjust the firmness and the compression of the applicator member.

In an exemplary embodiment, the application surface may comprise at least one of a flat surface, a recessed surface, and a domed surface. For applications entailing uniform distribution of the product allowing the application of a uniform film, such as in the case of a self-tanning agent for example, use may be made of at least one of a flat or domed (e.g., convex) surface. For other applications in which a larger quantity of product is applied, use may be made of a recessed (e.g., concave) surface. Optionally, the application surface may be inclined so as to encourage a determined angle of application.

In a further exemplary embodiment, the application surface may be oriented at least partially in a plane transverse to a longitudinal axis of the applicator member. Optionally, the plane may be perpendicular to the longitudinal axis of the applicator member. Alternatively, the plane may be inclined with respect to the longitudinal axis of the applicator member.

In another exemplary embodiment, an outer part of the applicator member may comprise at least one of flocking, a woven fabric, a non-woven fabric, a porous film, and a non-porous film.

In yet another exemplary embodiment, the application surface may comprise at least one projection extending over at least a part of the application surface. The at least one projection may be chosen from pips, bosses, and inscriptions. It thus may be possible to modify the sensations afforded by the application surface. The projecting elements may also allow at least part of the application surface to have a stimulating, massaging or drainage function and/or a function encouraging microcirculation.

In another exemplary embodiment, the applicator member may comprise a unitary part. The unitary part may be formed using at least one of machining and molding.

In a further exemplary embodiment, the applicator member may be formed with a cross-section having a shape chosen from circular, oval, and polygonal. The applicator member may be configured so that the shape of the applicator member does not taper substantially from the at least one second portion to the application surface.

In a still further exemplary embodiment, the applicator member may comprise a first part between a first groove and a second groove and a second part between the second groove and a third groove. A transverse dimension of the first part may be substantially the same as a transverse dimension of the second part. Optionally, the first part and the second part may have substantially the same diameter.

In another exemplary embodiment, the applicator member may comprise a first end portion secured to the removable closure element and a second end portion opposite to the first end portion. The applicator member may be configured so that a shape of the applicator member does not taper substantially from the first end portion to the second end portion.

In an exemplary embodiment, the application surface may comprise a substantially flat surface located at a free end portion of the applicator member. The application surface may comprise at least one concave curvature.

In a further exemplary embodiment, the at least one second portion of the applicator member may not be substantially compressed when the applicator member is disposed in the second housing and the closure element seals the opening.

In a still further exemplary embodiment, the at least one second portion of the applicator member may be configured to flex during application of the at least one product.

In an exemplary embodiment, the unit may further comprise a body defining the first housing and the second housing. Optionally, the body may comprise a single piece of material.

In a further exemplary embodiment, the unit may be configured so that the applicator member is completely removable from the second housing.

According to a further aspect of the invention, the unit may further comprise at least one product in the first housing. The at least one product may be in the form of one of a powder and a fluid. Further, the at least one product may comprise makeup.

In an exemplary embodiment, the unit may be configured so that the second housing is selectively in flow communication with the first housing. Alternatively, the second housing may be permanently in flow communication with the first housing.

In a further exemplary embodiment, the applicator member may be removable from the second housing via the opening.

In a still further exemplary embodiment, the applicator member may be secured to the removable closure element. The applicator member may be secured to the removable closure element by at least one of snap-fastening, screw-fastening, bonding, and welding.

Optionally, the applicator member may be secured to the removable closure element in such a way that the second portion is not visible from the outside, while at the same time fulfilling its function. For example, the closure element may comprise a skirt at least partially covering the second portion of the applicator member.

In an exemplary embodiment, the first housing and the second housing may be separated by an element permeable to the at least one product. The element may comprise, for example, at least one of a grating, a mesh, a one-way valve, a layer of foam, a woven fabric, and a non-woven fabric. Thus, the product present in the first housing may pass through the permeable element to reach the applicator member present in the second housing, which it may impregnate.

Another aspect of the invention relates to a method of applying product that may comprise providing a unit for applying at least one product, transferring at least some of the at least one product from the first housing to the second housing, loading the applicator member with product, and placing the application surface in contact with at least one of skin, hair, a finger nail, a toe nail, eyelashes, and eyebrows so as to apply product thereto.

The term "providing" is used in a broad sense, and refers to, but is not limited to, making available for use, enabling usage, giving, supplying, obtaining, getting a hold of, acquiring, purchasing, selling, distributing, possessing, making ready for use, and/or placing in a position ready for use.

In one aspect, the product may comprise at least one of lip make-up, foundation, blush, mascara, eye shadow, eye liner, and nail varnish. In another aspect, the product may comprise at least one of a powder and a fluid. In a still further aspect, the product may comprise at least one of cream, milk, gel, and a lotion.

According to another aspect of the method, the placing may cause a pressing force to be exerted on the application surface. The method may further comprise absorbing the pressing force at least substantially via the at least one second portion of the applicator member.

The accompanying drawings are included to provide a further understanding of certain aspects of the invention and are incorporated in and constitute part of the specification.

Figure 1:
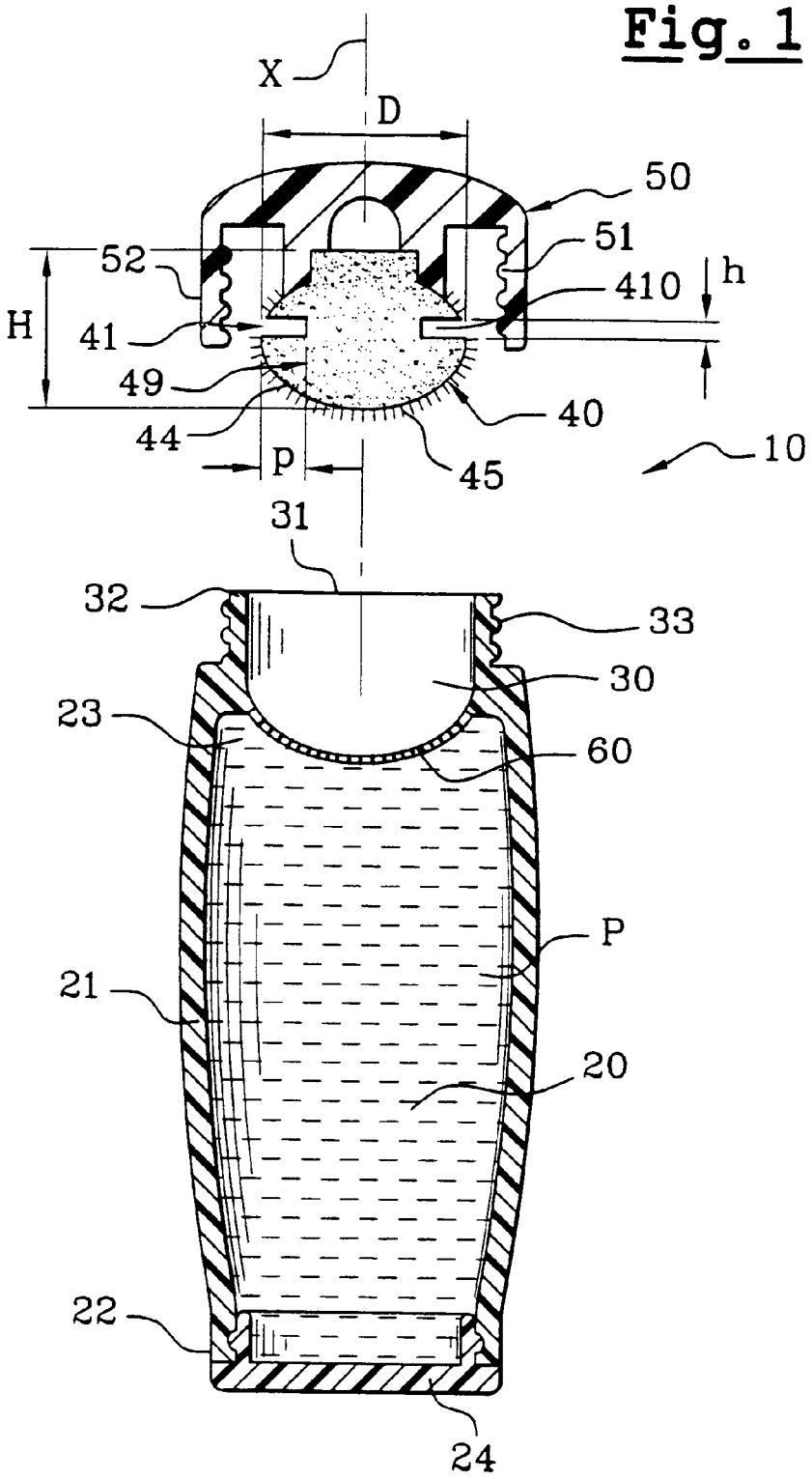
FIG. 1 is a cross-sectional view of the unit according to an exemplary embodiment of the invention.
Figure 1A:
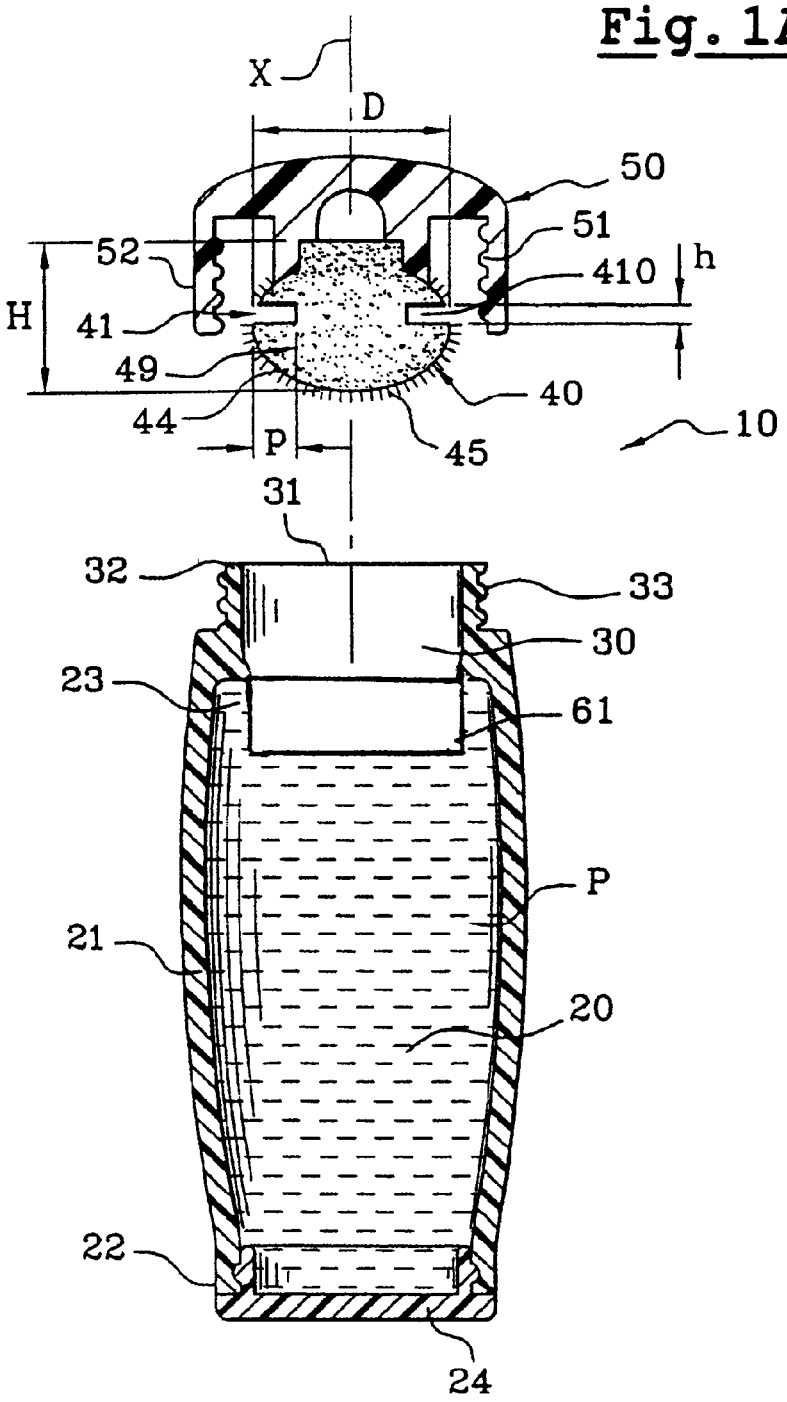
FIG. 1A is a cross-sectional view of the unit according to another exemplary embodiment of the invention.

An exemplary embodiment of the unit for applying at least one product is shown in FIG. 1. This unit comprises a substantially cylindrical body which delimits a first housing 20 delimited by a cylindrical skirt 21, a first end 22 of which is closed by an end wall 24 and a second end 23 of which is closed off by a transverse wall 60. The transverse wall 60 is a perforated element in the form of a grating. Other types of elements providing permanent or selective flow communication may also be used. For example, selective flow communication may be provided by a selective flow mechanism 61, as shown schematically in FIG. 1A.

The transverse wall 60 separates the first housing 20 from a second housing 30 situated above the first housing 20. The first housing 20 is configured to contain at least one product P which is, for example, a cosmetic or care product. The product P may be in liquid form, such as, for example, a liquid cream or liquid foundation. Alternatively, the product P may be in powder form, such as, for example, a foundation, an eye shadow, or a rouge.

The end wall of the upper housing 30 is formed by the transverse wall 60 and has a substantially hemispherical shape. One end of the housing 30, at the opposite end to the end wall 60, forms a free edge 32 delimiting an opening 31. The external surface of the housing 30 has a screw thread 33 configured to receive a corresponding screw thread 51 provided on the internal surface of a skirt 52 of a stopper 50.

An applicator 40 having a longitudinal axis X is secured to the stopper 50. The applicator 40 is produced in the form of a block of open-cell polyurethane foam having a substantially spherical shape. In this embodiment, the applicator 40 is shaped to correspond to the hemispherical profile defined by the end wall 60 of the housing 30. According to this embodiment, the applicator 40 has a domed (e.g., convex) application surface 44, which is covered with a flock coating 45. The applicator 40 is fixed to the stopper 50 by bonding.

The applicator 40 may be impregnated with the product by capillarity. Other techniques for loading the applicator 40 with product may also be used.

The applicator 40 is dimensioned with respect to the housing 30 in such a way that, when the stopper 50 is in the closed position, at least a portion of the application surface of the applicator 40 is in contact with the grating 60.

The applicator 40 has a first portion 49 adjacent to the application surface 44, and the applicator 40 also has at least one second portion 41 having a greater compressibility than the first portion 49. As shown in the embodiment of FIG. 1, the applicator 40 is equipped at the second portion 41 with a groove 410 opening onto a lateral surface over the entire periphery of the applicator and oriented in a plane perpendicular to the axis X. This is, for example, an annular groove whose cross section, with respect to the plane in which it runs, forms a U with a square bottom. By way of example, the applicator 40 has an axial height H along the axis X of about 35 mm and the broadest cross section thereof has a diameter D of about 35 mm. The groove 410 has an axial height h of about 5 mm and a depth p of about 10 mm. Alternatively, a discontinuous groove 410 formed over just part of the periphery of the applicator could be used.

The dimensions provided herein are given merely by way of non-limiting, illustrative example. These dimensions may vary according to the size of the applicator and the desired effect. Furthermore, these dimensions correspond to dimensions measured in the absence of any stress exerted on the applicator.

Figure 2:
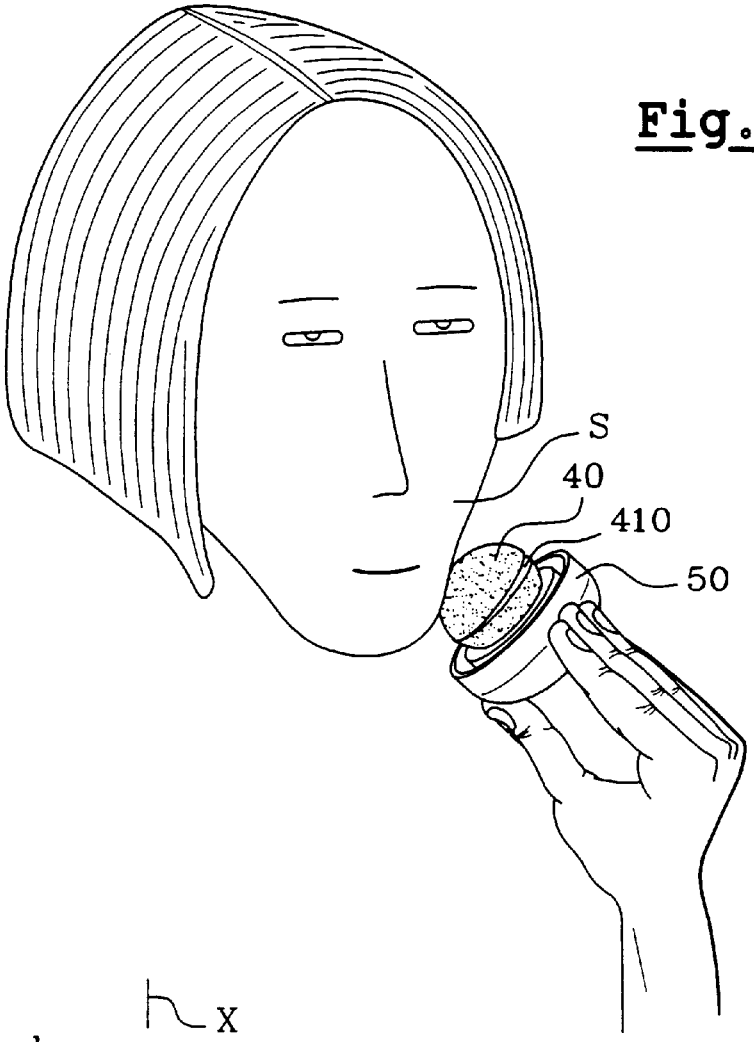
FIG. 2 is a perspective view of the unit of FIG. 1 in use.

During application, the user removes the stopper 50 and applies the application surface 44 of the applicator 40 to the surface S to be treated, for example her face, as is depicted in FIG. 2. The presence of the annular groove 410 may make it possible to reduce the pressing force exerted by the applicator on the face. Furthermore, the applicator 40 may adapt more readily to the surface of the face because the application surface pivots with respect to the member for holding, making it possible to obtain an application angle of the surface which differs from the angle at which the user holds the member for holding.

Figure 3A:
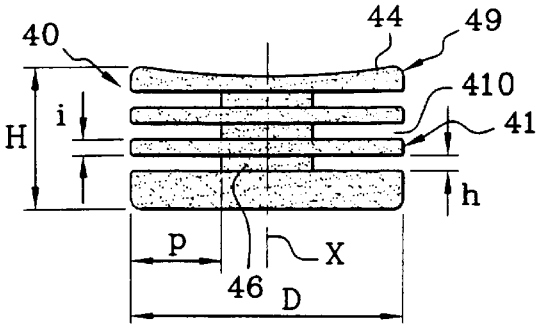
FIGS. 3A to 3O are cross-sectional views of the unit according to further exemplary embodiments of the invention.
Figure 3B:
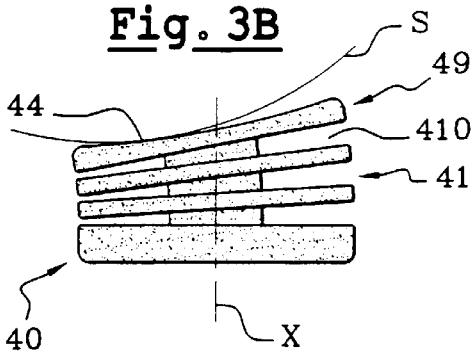
Figure 3C:
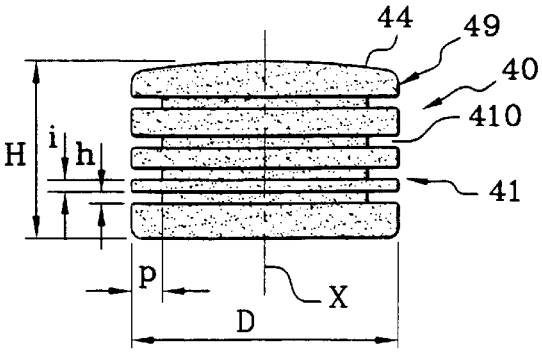
Figure 3D:
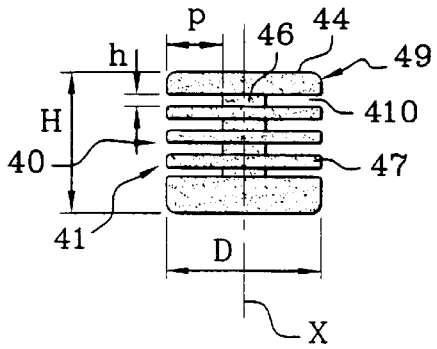
Figure 3E:
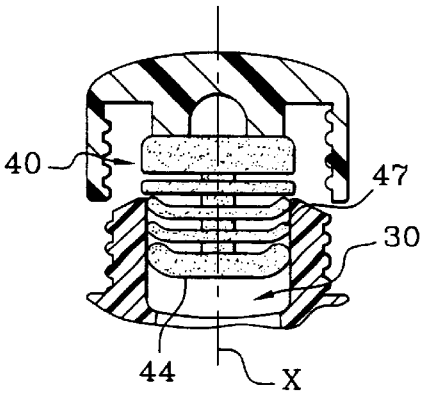
Figure 3F:
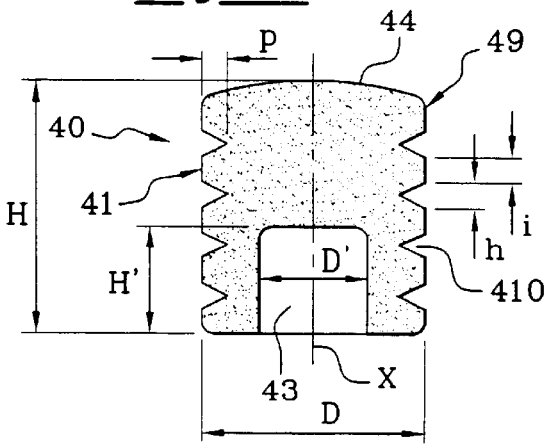
Figure 3G:
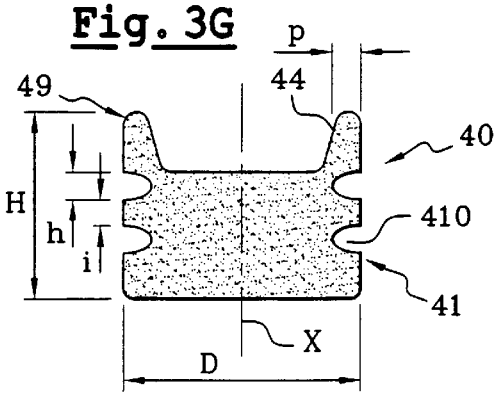
Figure 3H:
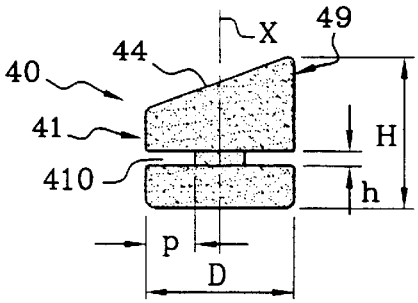
Figure 3I:
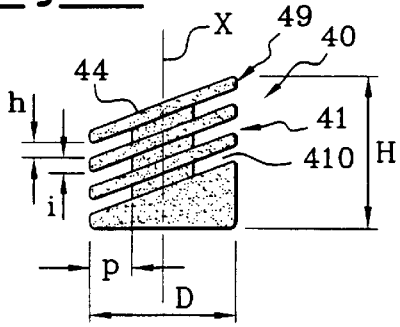
Figure 3J:
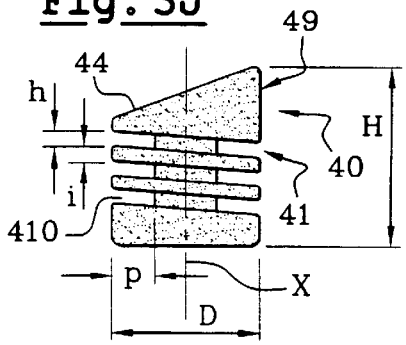
Figure 3K:
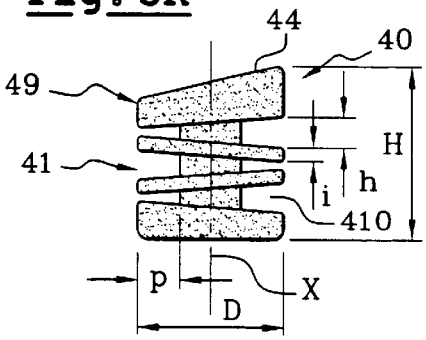
Figure 3L:
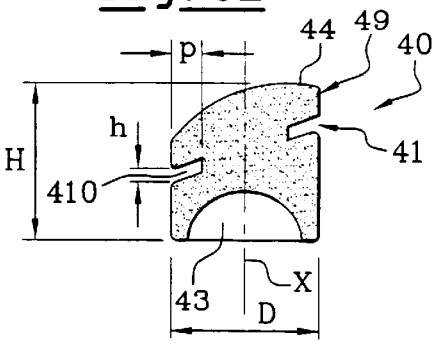
Figure 3M:
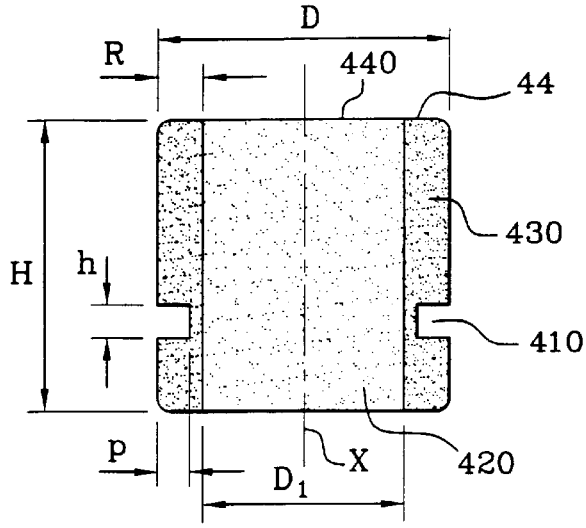
Figure 3N:
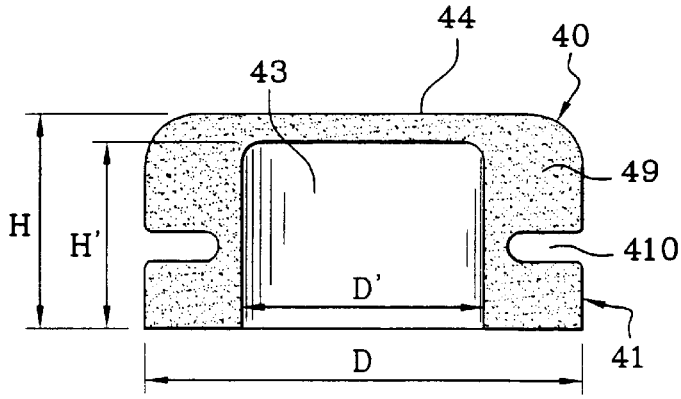
Figure 3O:
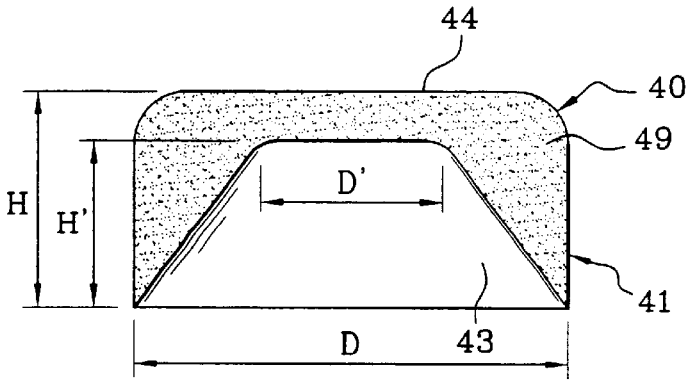

With reference to FIGS. 3A to 3O, it is possible to see various examples of alternative embodiments of the applicator 40. The applicator, including first portion 49 and second portion 41. is depicted by itself, but it may be mounted in a unit 10 of the type depicted in FIG. 1.

The applicator shown in FIGS. 3A and 3B is a block of polyester foam formed in a single piece. The applicator has a roughly cylindrical overall shape with an axial height H approximately equal to 20 mm and a circular cross section of diameter D equal approximately to 50 mm. The applicator has a slightly concave application surface 44 formed in a plane roughly perpendicular to the axis X. It is also equipped with three annular grooves 410 which are also formed in a plane roughly perpendicular to the axis X. The grooves 410 all have the same axial height h, this axial height being constant along the entire periphery. In the embodiment shown, the axial height h of the grooves is equal to about 2 mm. The spacing i between two grooves is identical between two consecutive grooves. It is equal to approximately 2 mm. Finally, the depth p of each groove is slightly smaller than the width of the central portion 46 of the applicator 40 lying in the same transverse plane. The grooves have, for example, a depth p equal to approximately 15 mm. As shown in FIG. 3B, the grooves 410 may allow the application surface 44 to pivot with respect to the axis X.

The applicator shown in FIG. 3C differs slightly from the one described with reference to FIGS. 3A and 3B. First, it has a convex application surface 44. Furthermore, it has four grooves 410 which are increasingly closely spaced as they become more distant from the application surface 44. The first and second grooves, starting from the application surface, are separated by a spacing i equal to about 5 mm, the second and third grooves are separated by a spacing i equal to about 3 mm, and finally, the third and fourth grooves are separated by a spacing i approximately equal to 2 mm. Finally, the depth of each groove is relatively small, namely smaller than the width of the central portion of the applicator 40 lying in the same transverse plane. The grooves have, for example, a depth p of about 5 mm.

The applicator 40 shown in FIGS. 3D and 3E differs from the one depicted in accordance with FIGS. 3A and 3B in that the application surface 44 is flat. Furthermore, the applicator has a roughly cylindrical overall shape having an axial height H equal to about 35 mm and a circular cross section of diameter D equal to approximately 35 mm. In addition, there are four grooves 410 with an axial height h approximately equal to 2 mm. The grooves are relatively shallow, their depth p being approximately equal to 15 mm. Thus, the depth p of the groove is greater than the width of the central portion 46 of the corresponding applicator lying in the same plane. This may yield greater biaxial flexibility. Furthermore, the presence of these grooves may make it easier for the applicator 40 to be introduced into its housing 30 because, as can be seen in FIG. 3E, the ends 47 of the portions of the applicator which are formed between each groove may bend easily.

FIG. 3F shows an applicator 40 comprising a block of polyethylene foam formed in a single piece. The applicator has a roughly cylindrical overall shape with an axial height H approximately equal to 40 mm and a circular cross section with a diameter D approximately equal to 35 mm. The applicator has a slightly convex application surface 44 formed in a plane approximately perpendicular to the axis X. It also has three annular grooves 410 which are also formed in a plane roughly perpendicular to the axis X. The grooves 410 are spaced apart by an identical distance i, approximately equal to 4 mm. The grooves 410 have, for example, a cross-section transverse to the plane in which they run that is V-shaped. The greatest axial height h of each groove is approximately equal to 4 mm. The applicator 40 is also equipped with a central cavity 43 of cylindrical shape. The central cavity has an axial height H' approximately equal to 17 mm and a cross section of diameter D' approximately equal to 17 mm. The cavity 43 is arranged in the second portion of the applicator away from the application surface 44. The cavity may allow the firmness and compression of the applicator member to be adjusted. With this arrangement, shallow grooves 410, having a depth p approximately equal to 4 mm, may be used. Grooves of other dimensions may also be used.

The applicator 40 depicted in FIG. 3N differs from the one depicted in FIG. 3F in that its axial height H is not as great as its width D. Furthermore, it has just one groove 410 of U-shaped cross section. Furthermore, it is equipped with a cavity 43 which extends over practically its entire axial height H and over a great part of its width D. The axial height H' of the cavity is actually slightly less than the axial height H of the applicator so that the applicator has a small thickness below the central part of the application surface 44. Such a configuration may allow even gentler application.

FIG. 3O depicts an applicator which differs from that depicted in FIG. 3N in that it has no groove, and in that the cavity this time has a frustoconical shape. The portion 41 of higher compressibility is this time only due to the presence of the cavity 43. The cavity 43 has a cross section of a diameter roughly equal to the diameter D of the cross section of the applicator at the base of the applicator narrowing towards the application surface 44 down to a diameter D'. The axial height H' of the cavity is slightly less than the axial height H of the applicator so that the applicator 40 has a small thickness below the central part of the application surface 44.

The applicator 40 depicted in FIG. 3G comprises a block of polyvinyl chloride foam formed as a single piece. The applicator has a roughly cylindrical overall shape of circular cross section which has a diameter D approximately equal to 40 mm and an axial height H approximately equal to 50 mm. The applicator has a hollow application surface 44 formed in a plane roughly perpendicular to the axis X allowing it to apply a relatively large amount of product. It is also equipped with two annular grooves 410 which are also formed in a plane roughly perpendicular to the axis X. The grooves 410 have a cross section transverse to the plane in which they run that is U-shaped with a rounded bottom. Their greatest axial height h is approximately equal to 5 mm and they are separated from one another by a distance i approximately equal to 5 mm. Their depth p is relatively small, for example equal to 5 mm.

The arrangements of the applicator member which are shown in FIGS. 3H to 3L have an application surface 44 formed in a plane which is inclined with respect to the axis X.

In FIG. 3H, the applicator comprises a block formed from a single piece of polyethylene-vinyl acetate foam. The applicator has a roughly cylindrical overall shape of circular cross section which has a diameter D approximately equal to 45 mm and a largest axial height H approximately equal to 50 mm. The applicator has an application surface 44 which is roughly flat and formed in a plane which is inclined with respect to the axis X. It is also equipped with a single groove 410 of axial height h approximately equal to 5 mm. The groove 410 is formed in a plane perpendicular to the axis X. The groove 410 has a cross section transverse to the plane in which it runs which is U-shaped with a square bottom. The depth p of the groove 410 is approximately equal to 15 mm.

In FIG. 31, the applicator differs from the one described in accordance with FIG. 3H in that it is equipped with three grooves 410 of smaller axial height h, approximately 3 mm, which are arranged in a plane which is inclined with respect to the axis X. They are arranged in planes which are parallel to one another and parallel to the application surface 44. The grooves 410 are spaced apart by a constant distance i, for example equal to the axial height of the grooves. The grooves have a depth whose component p along the axis perpendicular to X is approximately equal to 8 mm.

In FIG. 3J, the applicator is identical to the one described in FIG. 31 except that the grooves 410 run in a plane which is inclined with respect to the axis X and which is not parallel to the plane of the application surface 44.

The applicator depicted in FIG. 3K differs from the one illustrated in FIG. 31 in that the three grooves 410 have an axial height h which is not constant along the entire periphery. This axial height h varies between 3 mm and 6 mm.

The applicator depicted in FIG. 3L differs from the one depicted in FIG. 3H in that it has a convex application surface 44. Furthermore, the single groove extends in a plane which is inclined with respect to the axis X, roughly parallel to the plane in which the application surface is formed. The groove has a depth whose component p along an axis perpendicular to X is approximately equal to 8 mm. The applicator 40 is also equipped with a central cavity 43 of substantially hemispherical shape.

In the embodiments shown in FIGS. 3A to 3N, the grooves 410 are formed around the entire periphery of the applicator. Alternatively, the grooves may be formed over only a portion of the periphery of the applicator.

According to another embodiment shown in FIG. 3M, the applicator 40 is formed of two concentric blocks of foam 420 and 430 of the same nature, for example a polyether foam with different densities, the central block 420 being of greater density than the outer block 430. The applicator has a roughly cylindrical overall shape of circular-cross section which has a diameter D approximately equal to 45 mm and an axial height H approximately equal to 45 mm.

The central block 420 is of cylindrical overall shape and has a diameter Dl approximately equal to 31 mm. The outer block 430, of annular overall shape, has a radius R approximately equal to 7 mm. The applicator has a flat application surface 44 formed in a plane roughly perpendicular to the axis X. It is also equipped with an annular groove 410 which is also formed in a plane roughly perpendicular to the axis X. The groove 410 is an annular groove with a cross section transverse to the plane in which it runs that is U-shaped with a square bottom. The groove 410 has an axial height h approximately equal to 5 mm and a depth p approximately equal to 5 mm. Axial slots, as described below with reference to FIG. 4, may also be added to the central block.

According to the embodiment shown in FIG. 3M, the application surface 44 has a central portion 440 which differs from the rest of the application surface, in that it is firmer in the present example, because the central block of foam 420 has a higher density than the outer block 430. If two concentric blocks 420 and 430 of different types are being used, it may be possible to choose a central block 420 which has an abrasive function and an outer block 430 which is gentler, or vice versa. Other arrangements are also possible.

According to an undepicted alternative form of this embodiment, the central block 420 has a cavity. According to another undepicted alternative form, the central block does not extend over the entire axial height H of the applicator. According to another alternative form, the outer block partially covers the central block, i.e., it does not extend over the entire axial height H of the applicator. In this last alternative form, the central block may have a cross section of larger diameter over the rest of the axial height so that the outer surface of the applicator is approximately continuous. Grooves or axial slots of the type which will be described below in accordance with FIG. 4 may be formed in the portion of the central block of largest cross section. Alternatively, the outer block may cover the central block over substantially its entire end adjacent to the application surface so that the application surface is substantially formed by the outer block.

Figure 4:
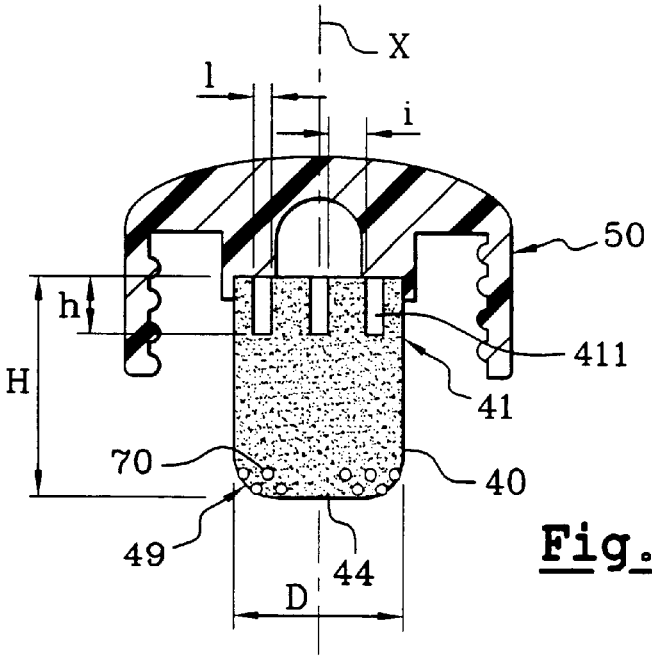
FIG. 4 is a cross-sectional view of the unit according to a further exemplary embodiment of the invention.

According to a further embodiment of the invention, shown in FIG. 4, the applicator is equipped with slots 411 formed along the axis X of the applicator. Like the grooves described earlier, the axial slots 411 may adopt different configurations which are not depicted. There may be a single slot or several slots of greater or lesser axial height h, which may be constant or may vary along the periphery of the applicator. The slot or slots may have a constant width I along their entire axial height or alternatively may vary along the axis X. When the applicator is equipped with several slots, these may all have the same width I or may have different widths. They may be spaced radially apart by a spacing i which is identical or different. The slots 411 may also be inclined to a greater or lesser extent with respect to the axis X.

In the embodiment shown in FIG. 4, the applicator has a roughly cylindrical overall shape of circular cross-section that has a diameter D approximately equal to 33 mm and an axial height H approximately equal to 45 mm. The applicator has a roughly flat application surface 44 formed in a plane perpendicular to the axis X. The applicator is equipped with several slots 411 spaced radially in a uniform fashion by a distance approximately equal to 8 mm. Each slot 411 has a width I approximately equal to 3 mm and an axial height h approximately equal to 8 mm.

According to this embodiment, the applicator is covered with elements 70 which project from the application surface. These are, for example, relief impressions.

Figure 5:
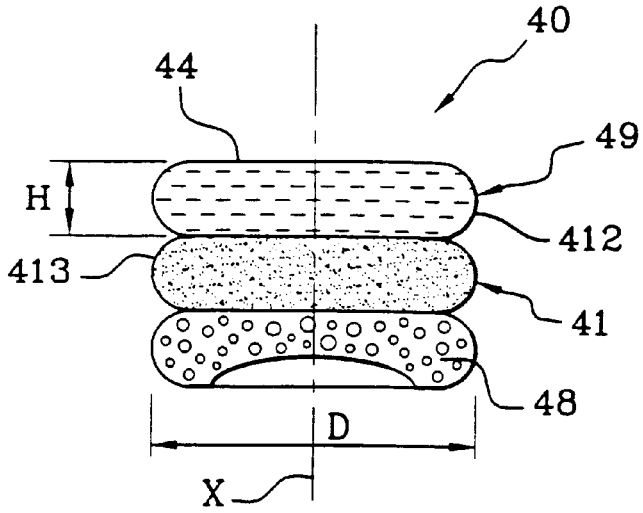
FIG. 5 is a cross-sectional view of the unit according to a further exemplary embodiment of the invention.

According to a further embodiment shown in FIG. 5, the applicator 40 comprises an axial stack of blocks of foam of different natures. According to this embodiment, the applicator comprises three blocks of foam 412, 413 and 48, each of cylindrical overall shape, stacked axially and bonded together. Other numbers of blocks may also be used. The three blocks have the same axial height H, for example, approximately equal to 12 mm, and have a cross section of the same diameter D, for example, approximately equal to 45 mm. The central block of foam 413 is more compressible than the other blocks of foam so as to encourage compression of the applicator 40. The block of foam 412 defining the application surface is made of polyether, the central block of foam 413 is made of natural rubber (Natural Butadiene Rubber) and the third block of foam 48 is made of polyurethane. The rest of the applicator unit is identical to the one described in accordance with FIG. 1.

Figure 6:
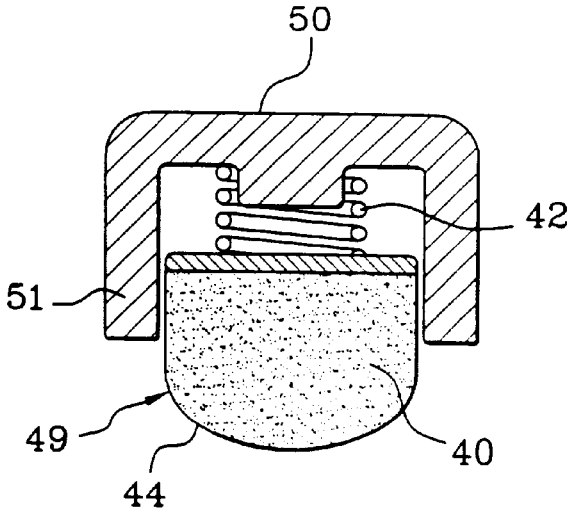
FIG. 6 is a cross-sectional view of the unit according to a further exemplary embodiment of the invention.

According to a further embodiment depicted in FIG. 6, the applicator 40 comprises a thermoplastic elastomer frit. The applicator 40 is mounted on the stopper 50 by a spring 42. The spring may make it possible to absorb, in part, the pressing force exerted by the applicator on the face. The spring stiffness may be chosen according to the gentleness of application that is to be obtained. The stopper 50 comprises a skirt 51 which covers the spring 42.

The spring 42 may also be used with the applicator member according to the other exemplary embodiments. In addition, other types of springs and other elastic members may also be used.

Optionally, the applicator according to any one of the embodiments described herein may be provided with a sheath made of a compressible material surrounding at least a part of the second portion 41, such as, for example, the region of the grooves and/or slots. The sheath may comprise, for example, a skin which may or may not be impervious to the product. The sheath may furthermore be covered with projecting elements. It may also be retractable.

In a further exemplary arrangement, the applicator may further contain a water-absorbing and/or oil-absorbing additive, depending on the product absorbed into the applicator, so as to keep the product in the applicator. Additives such as silicates or alginates may be used. Thus, the applicator may be saturated with product without the product tending to run out of the applicator. The applicator 40 may also contain anti-fungal agents and/or bactericides. The applicator may also contain magnetic particles.

It will be apparent to those skilled in the art that various modifications and variations can be made to the structure and methodology of the present invention. Thus, it should be understood that the invention is not limited to the examples discussed in the specification. Rather, the present invention is intended to cover modifications and variations.

What is claimed is:

1. A unit for applying at least one product, the unit comprising:

a first housing configured to contain at least one product;

a second housing configured to be at least temporarily in flow communication with the first housing, the second housing comprising an opening defined by an edge;

a removable closure element configured to substantially seal the opening of the second housing; and an applicator member removably disposed in the second housing, the applicator member comprising an application surface, a first portion adjacent to the application surface, and at least one second portion separated from the application surface by the first portion, the at least one second portion being configured to have a greater compressibility than the first portion such that the applicator member at least partially absorbs pressing force exerted on the application surface during application of the at least one product.

2. The unit of claim 1, wherein the at least one second portion of the applicator member at least substantially absorbs the pressing force.

3. The unit of claim 1, further comprising at least one product in the first housing.

4. The unit of claim 3, wherein the at least one product is chosen from cosmetic products and care products.

5. The unit of claim 3, wherein the at least one product is in the form of one of a powder and a fluid.

6. The unit of claim 1, wherein the unit is configured so that the second housing is selectively in flow communication with the first housing.

7. The unit of claim 1, wherein the second housing is permanently in flow communication with the first housing.

8. The unit of claim 1, wherein the applicator member is removable from the second housing via the opening.

9. The unit of claim 1, wherein the applicator member is secured to the removable closure element.

10. The unit of claim 9, wherein the applicator member is secured to the removable closure element by at least one of snap-fastening, screw-fastening, bonding, and welding.

11. The unit of claim 1, wherein the first portion of the applicator member comprises a compressible material.

12. The unit of claim 11, wherein the first portion of the applicator member comprises at least one of an open-cell foam, a semi-open-cell foam, and a frit comprising a flexible material.

13. The unit of claim 12, wherein the at least one of an open-cell foam and a semi-open-cell foam comprises at least one of polyurethane, polyethylene, polyvinyl chloride, polyester, polyether, polyethylene-vinyl acetate, polyvinyl acetate foam, natural foam rubber, and synthetic foam rubber.

14. The unit of claim 12, wherein the flexible material is chosen from elastomers, thermoplastic elastomers, polyvinyl chlorides, and polyethylene-vinyl acetates.

15. The unit of claim 1, wherein at least a part of the at least one second portion of the applicator member comprises the same material as the first portion of the applicator member.

16. The unit of claim 15, wherein the at least a part of the at least one second portion of the applicator member has a cross-sectional area over at least part of its axial height smaller than a cross-sectional area of the first portion of the applicator member.

17. The unit of claim 1, wherein the at least one second portion of the applicator member comprises at least one groove in a lateral surface of the applicator member.

18. The unit of claim 17, wherein the at least one groove is formed over at least part of a periphery of the applicator member.

19. The unit of claim 17, wherein the at least one groove is oriented at least partially in a plane transverse to a longitudinal axis of the applicator member.

20. The unit of claim 19, wherein the plane is perpendicular to the longitudinal axis of the applicator member.

21. The unit of claim 19, wherein the plane is inclined with respect to the longitudinal axis of the applicator member.

22. The unit of claim 19, wherein the at least one groove has a cross-section transverse to the plane in which it is oriented, the cross-section comprising one of a C-shape, a U-shape with a square bottom, a U-shape with a rounded bottom, and a V-shape.

23. The unit of claim 17, wherein the at least one groove comprises a plurality of grooves.

24. The unit of claim 23, wherein, in the absence of force exerted on the application surface, the grooves have substantially the same axial height.

25. The unit of claim 23, wherein, in the absence of force exerted on the application surface, at least one of the grooves has a non-constant axial height.

26. The unit of claim 23, wherein, in the absence of force exerted on the application surface, the grooves are spaced apart substantially evenly.

27. The unit of claim 23, wherein, in the absence of force exerted on the application surface, the grooves are spaced apart unevenly.

28. The unit of claim 23, wherein the plurality of grooves comprises at least three grooves.

29. The unit of claim 23, wherein a space between two successive grooves is greater than the axial height of each of the two successive grooves.

30. The unit of claim 1, wherein the at least one second portion of the applicator member comprises at least one substantially axial slot.

31. The unit of claim 30, wherein the at least one substantially axial slot comprises a plurality of slots spaced laterally across the applicator member.

32. The unit of claim 31, wherein the slots are spaced apart substantially evenly.

33. The unit of claim 1, wherein the first portion of the applicator member comprises a first material and the second portion of the applicator member comprises a second material different from the first material.

34. The unit of claim 1, wherein the first portion of the applicator member comprises a first material and the second portion of the applicator member comprises a second material having a greater compressibility than the first material.

35. The unit of claim 1, wherein the at least one second portion of the applicator member comprises at least one of an open-cell foam and a semi-open-cell foam.

36. The unit of claim 35, wherein the at least one of an open-cell foam and a semi-open-cell foam comprises at least one of polyurethane, polyethylene, polyvinyl chloride, polyester, polyether, polyethylene-vinyl acetate, polyvinyl acetate foam, natural foam rubber, and synthetic foam rubber.

37. The unit of claim 1, wherein the at least one second portion of the applicator member comprises a spring.

38. The unit of claim 1, wherein the applicator member comprises a unitary part.

39. The unit of claim 38, wherein the unitary part is formed using at least one of machining and molding.

40. The unit of claim 1, wherein the at least one second portion of the applicator member defines a central cavity.

41. The unit of claim 1, wherein the application surface comprises at least one of a flat surface, a recessed surface, and a domed surface.

42. The unit of claim 1, wherein the application surface is oriented at least partially in a plane transverse to a longitudinal axis of the applicator member.

43. The unit of claim 42, wherein the plane is perpendicular to the longitudinal axis of the applicator member.

44. The unit of claim 42, wherein the plane is inclined with respect to the longitudinal axis of the applicator member.

45. The unit of claim 1, wherein an outer part of the applicator member comprises at least one of flocking, a woven fabric, a non-woven fabric, a porous film, and a nonporous film.

46. The unit of claim 1, wherein the application surface comprises at least one projection extending over at least a part of the application surface.

47. The unit of claim 46, wherein the at least one projection is chosen from pips, bosses, and inscriptions.

48. The unit of claim 1, wherein the applicator member is formed with a cross-section having a shape chosen from circular, oval, and polygonal.

49. The unit of claim 1, wherein the removable closure element comprises a skirt at least partially covering the second portion of the applicator member.

50. The unit of claim 1, wherein the first housing and the second housing are separated by an element permeable to the at least one product.

51. The unit of claim 50, wherein the element comprises at least one of a grating, a mesh, a one-way valve, a layer of foam, a woven fabric, and a non-woven fabric.

52. The unit of claim 3, wherein the at least one product comprises makeup.

53. The unit of claim 1, wherein the applicator member is configured so that the shape of the applicator member does not taper substantially from the at least one second portion to the application surface.

54. The unit of claim 17, wherein the at least one groove has a non-circular shape.

55. The unit of claim 28, wherein the applicator member comprises a first part between a first groove and a second groove and a second part between the second groove and a third groove, wherein a transverse dimension of the first part is substantially the same as a transverse dimension of the second part.

56. The unit of claim 55, wherein the first part and the second part have substantially the same diameter.

57. The unit of claim 1, wherein the applicator member comprises a first end portion secured to the removable closure element and a second end portion opposite to the first end portion, wherein the applicator member is configured so that a shape of the applicator member does not taper substantially from the first end portion to the second end portion.

58. The unit of claim 1, wherein the application surface comprises a substantially flat surface located at a free end portion of the applicator member.

59. The unit of claim 1, wherein the application surface comprises at least one concave curvature.

60. The unit of claim 1, wherein the at least one second portion of the applicator member is not substantially compressed when the applicator member is disposed in the second housing and the closure element seals the opening.

61. The unit of claim 1, wherein the at least one second portion of the applicator member is configured to flex during application of the at least one product.

62. The unit of claim 1, further comprising a body defining the first housing and the second housing.

63. The unit of claim 62, wherein the body comprises a single piece of material.

64. The unit of claim 1, wherein the unit is configured so that the applicator member is completely removable from the second housing.

65. A method of applying product, comprising:

providing the unit of claim 1;

transferring at least some of the at least one product from the first housing to the second housing;

loading the applicator member with product; and placing the application surface in contact with at least one of skin, hair, a finger nail, a toe nail, eyelashes, and eyebrows so as to apply product thereto.

66. The method of claim 65, wherein the product comprises at least one of lip make-up, foundation, blush, mascara, eye shadow, eye liner, and nail varnish.

67. The method of claim 65, wherein the product comprises at least one of a powder and a fluid.

68. The method of claim 65, wherein the product comprises at least one of cream, milk, gel, and a lotion.

69. The method of claim 68, wherein the placing causes a pressing force to be exerted on the application surface and wherein the method further comprises absorbing the pressing force at least substantially via the at least one second portion of the applicator member.

70. A unit for applying at least one product, the unit comprising:

a first housing configured to contain at least one product;

a second housing configured to be at least temporarily in flow communication with the first housing, the second housing comprising an opening defined by an edge;

a removable closure element configured to substantially seal the opening of the second housing; and an applicator member removably disposed in the second housing, the applicator member comprising an application surface, a first portion adjacent to the application surface, and at least one second portion separated from the application surface by the first portion, the at least one second portion being configured to have a greater compressibility than the first portion such that the application surface pivots in response to pressing force exerted on the application surface during application of the at least one product.

71. The unit of claim 70, wherein the application surface pivots at least at the at least one second portion of the applicator member.

72. The unit of claim 70, further comprising at least one product in the first housing.

73. The unit of claim 72, wherein the at least one product is chosen from cosmetic products and care products.

74. The unit of claim 72, wherein the at least one product is in the form of one of a powder and a fluid.

75. The unit of claim 70, wherein the unit is configured so that the second housing is selectively in flow communication with the first housing.

76. The unit of claim 70, wherein the second housing is permanently in flow communication with the first housing.

77. The unit of claim 70, wherein the applicator member is removable from the second housing via the opening.

78. The unit of claim 70, wherein the applicator member is secured to the removable closure element.

79. The unit of claim 78, wherein the applicator member is secured to the removable closure element by at least one of snap-fastening, screw-fastening, bonding, and welding.

80. The unit of claim 70, wherein the first portion of the applicator member comprises a compressible material.

81. The unit of claim 80, wherein the first portion of the applicator member comprises at least one of an open-cell foam, a semi-open-cell foam, and a frit comprising a flexible material.

82. The unit of claim 81, wherein the at least one of an open-cell foam and a semi-open-cell foam comprises at least one of polyurethane, polyethylene, polyvinyl chloride, polyester, polyether, polyethylene-vinyl acetate, polyvinyl acetate foam, natural foam rubber, and synthetic foam rubber.

83. The unit of claim 81, wherein the flexible material is chosen from elastomers, thermoplastic elastomers, polyvinyl chlorides, and polyethylene-vinyl acetates.

84. The unit of claim 70, wherein at least a part of the at least one second portion of the applicator member comprises the same material as the first portion of the applicator member.

85. The unit of claim 84, wherein the at least a part of the at least one second portion of the applicator member has a cross-sectional area over at least part of its axial height smaller than a cross-sectional area of the first portion of the applicator member.

86. The unit of claim 70, wherein the at least one second portion of the applicator member comprises at least one groove in a lateral surface of the applicator member.

87. The unit of claim 86, wherein the at least one groove is formed over at least part of a periphery of the applicator member.

88. The unit of claim 86, wherein the at least one groove is oriented at least partially in a plane transverse to a longitudinal axis of the applicator member.

89. The unit of claim 88, wherein the plane is perpendicular to the longitudinal axis of the applicator member.

90. The unit of claim 88, wherein the plane is inclined with respect to the longitudinal axis of the applicator member.

91. The unit of claim 86, wherein the at least one groove comprises a plurality of grooves.

92. The unit of claim 91, wherein, in the absence of force exerted on the application surface, the grooves have substantially the same axial height.

93. The unit of claim 91, wherein, in the absence of force exerted on the application surface, at least one of the grooves has a non-constant axial height.

94. The unit of claim 91, wherein, in the absence of force exerted on the application surface, the grooves are spaced apart substantially evenly.

95. The unit of claim 91, wherein, in the absence of force exerted on the application surface, the grooves are spaced apart unevenly.

96. The unit of claim 91, wherein the plurality of grooves comprises at least three grooves.

97. The unit of claim 91, wherein a space between two successive grooves is greater than the axial height of each of the two successive grooves.

98. The unit of claim 88, wherein the at least one groove has a cross-section transverse to the plane in which it is oriented, the cross-section comprising one of a C-shape, a U-shape with a square bottom, a U-shape with a rounded bottom, and a V-shape.

99. The unit of claim 70, wherein the at least one second portion of the applicator member comprises at least one substantially axial slot.

100. The unit of claim 98, wherein the at least one substantially axial slot comprises a plurality of slots spaced laterally across the applicator member.

101. The unit of claim 100, wherein the slots are spaced apart substantially evenly.

102. The unit of claim 70, wherein the first portion of the applicator member comprises a first material and the second portion of the applicator member comprises a second material different from the first material.

103. The unit of claim 70, wherein the first portion of the applicator member comprises a first material and the second portion of the applicator member comprises a second material having a greater compressibility than the first material.

104. The unit of claim 70, wherein the at least one second portion of the applicator member comprises at least one of an open-cell foam and a semi-open-cell foam.

105. The unit of claim 104, wherein the at least one of an open-cell foam and a semi-open-cell foam comprises at least one of polyurethane, polyethylene, polyvinyl chloride, polyester, polyether, polyethylene-vinyl acetate, polyvinyl acetate foam, natural foam rubber, and synthetic foam rubber.

106. The unit of claim 70, wherein the at least one second portion of the applicator member comprises a spring.

107. The unit of claim 70, wherein the applicator member comprises a unitary part.

108. The unit of claim 107, wherein the unitary part is formed using at least one of machining and molding.

109. The unit of claim 70, wherein the at least one second portion of the applicator member defines a central cavity.

110. The unit of claim 70, wherein the application surface comprises at least one of a flat surface, a recessed surface, and a domed surface.

111. The unit of claim 70, wherein the application surface is oriented at least partially in a plane transverse to a longitudinal axis of the applicator member.

112. The unit of claim 111, wherein the plane is perpendicular to the longitudinal axis of the applicator member.

113. The unit of claim 111, wherein the plane is inclined with respect to the longitudinal axis of the applicator member.

114. The unit of claim 70, wherein an outer part of the applicator member comprises at least one of flocking, a woven fabric, a non-woven fabric, a porous film, and a non-porous film.

115. The unit of claim 70, wherein the application surface comprises at least one projection extending over at least a part of the application surface.

116. The unit of claim 115, wherein the at least one projection is chosen from pips, bosses, and inscriptions.

117. The unit of claim 70, wherein the applicator member is formed with a cross-section having a shape chosen from circular, oval, and polygonal.

118. The unit of claim 70, wherein the removable closure element comprises a skirt at least partially covering the second portion of the applicator member.

119. The unit of claim 70, wherein the first housing and the second housing are separated by an element permeable to the at least one product.

120. The unit of claim 119, wherein the element comprises at least one of a grating, a mesh, a one-way valve, a layer of foam, a woven fabric, and a non-woven fabric.

121. The unit of claim 72, wherein the at least one product comprises makeup.

122. The unit of claim 70, wherein the applicator member is configured so that the shape of the applicator member does not taper substantially from the at least one second portion to the application surface.

123. The unit of claim 86, wherein the at least one groove has a non-circular shape.

124. The unit of claim 96, wherein the applicator member comprises a first part between a first groove and a second groove and a second part between the second groove and a third groove, wherein a transverse dimension of the first part is substantially the same as a transverse dimension of the second part.

125. The unit of claim 124, wherein the first part and the second part have substantially the same diameter.

126. The unit of claim 70, wherein the applicator member comprises a first end portion secured to the removable closure element and a second end portion opposite to the first end portion, wherein the applicator member is configured so that a shape of the applicator member does not taper substantially from the first end portion to the second end portion.

127. The unit of claim 70, wherein the application surface comprises a substantially flat surface located at a free end portion of the applicator member.

128. The unit of claim 70, wherein the application surface comprises at least one concave curvature.

129. The unit of claim 70, wherein the at least one second portion of the applicator member is not substantially compressed when the applicator member is disposed in the second housing and the closure element seals the opening.

130. The unit of claim 70, wherein the at least one second portion of the applicator member is configured to flex during application of the at least one product.

131. The unit of claim 70, further comprising a body defining the first housing and the second housing.

132. The unit of claim 131, wherein the body comprises a single piece of material.

133. The unit of claim 70, wherein the unit is configured so that the applicator member is completely removable from the second housing.

134. A method of applying product, comprising:

providing the unit of claim 70;

transferring at least some of the at least one product from the first housing to the second housing;

loading the applicator member with product; and placing the application surface in contact with at least one of skin, hair, a finger nail, a toe nail, eyelashes, and eyebrows so as to apply product thereto.

135. The method of claim 134, wherein the product comprises at least one of lip make-up, foundation, blush, mascara, eye shadow, eye liner, and nail varnish.

136. The method of claim 134, wherein the product comprises at least one of a powder and a fluid.

137. The method of claim 134, wherein the product comprises at least one of cream, milk, gel, and a lotion.

138. The method of claim 137, wherein the placing causes a pressing force to be exerted on the application surface and wherein the method further comprises pivoting the application surface at least at the at least one second portion of the applicator member.

139. A unit for applying at least one product, the unit comprising:

a first housing configured to contain at least one product;

a second housing configured to be at least temporarily in flow communication with the first housing, the second housing comprising an opening defined by an edge;

a removable closure element configured to substantially seal the opening of the second housing; and an applicator member removably disposed in the second housing, the applicator member comprising an application surface, a first portion adjacent to the application surface, and at least one second portion separated from the application surface by the first portion, the at least one second portion being configured to have a greater compressibility than the first portion such that the applicator member flexes in response to pressing force exerted on the application surface during application of the at least one product.

140. The unit of claim 139, wherein the at least one second portion of the applicator member flexes in response to pressing force exerted on the application surface during application of the at least one product.

141. The unit of claim 139, wherein flexing of the applicator member occurs at least substantially at the at least one second portion of the applicator member.

142. The unit of claim 139, further comprising at least one product in the first housing.

143. The unit of claim 142, wherein the at least one product is chosen from cosmetic products and care products.

144. The unit of claim 142, wherein the at least one product is in the form of one of a powder and a fluid.

145. The unit of claim 139, wherein the unit is configured so that the second housing is selectively in flow communication with the first housing.

146. The unit of claim 139, wherein the second housing is permanently in flow communication with the first housing.

147. The unit of claim 139, wherein the applicator member is removable from the second housing via the opening.

148. The unit of claim 139, wherein the applicator member is secured to the removable closure element.

149. The unit of claim 148, wherein the applicator member is secured to the removable closure element by at least one of snap-fastening, screw-fastening, bonding, and welding.

150. The unit of claim 139, wherein the first portion of the applicator member comprises a compressible material.

151. The unit of claim 150, wherein the first portion of the applicator member comprises at least one of an open-cell foam, a semi-open-cell foam, and a frit comprising a flexible material.

152. The unit of claim 151, wherein the at least one of an open-cell foam and a semi-open-cell foam comprises at least one of polyurethane, polyethylene, polyvinyl chloride, polyester, polyether, polyethylene-vinyl acetate, polyvinyl acetate foam, natural foam rubber, and synthetic foam rubber.

153. The unit of claim 151, wherein the flexible material is chosen from elastomers, thermoplastic elastomers, polyvinyl chlorides, and polyethylene-vinyl acetates.

154. The unit of claim 139, wherein at least a part of the at least one second portion of the applicator member comprises the same material as the first portion of the applicator member.

155. The unit of claim 154, wherein the at least a part of the at least one second portion of the applicator member has a cross-sectional area over at least part of its axial height smaller than a cross-sectional area of the first portion of the applicator member.

156. The unit of claim 139, wherein the at least one second portion of the applicator member comprises at least one groove in a lateral surface of the applicator member.

157. The unit of claim 156, wherein the at least one groove is formed over at least part of a periphery of the applicator member.

158. The unit of claim 156, wherein the at least one groove is oriented at least partially in a plane transverse to a longitudinal axis of the applicator member.

159. The unit of claim 158, wherein the plane is perpendicular to the longitudinal axis of the applicator member.

160. The unit of claim 158, wherein the plane is inclined with respect to the longitudinal axis of the applicator member.

161. The unit of claim 156, wherein the at least one groove comprises a plurality of grooves.

162. The unit of claim 161, wherein, in the absence of force exerted on the application surface, the grooves have substantially the same axial height.

163. The unit of claim 161, wherein, in the absence of force exerted on the application surface, at least one of the grooves has a non-constant axial height.

164. The unit of claim 161, wherein, in the absence of force exerted on the application surface, the grooves are spaced apart substantially evenly.

165. The unit of claim 161, wherein, in the absence of force exerted on the application surface, the grooves are spaced apart unevenly.

166. The unit of claim 161, wherein the plurality of grooves comprises at least three grooves.

167. The unit of claim 161, wherein a space between two successive grooves is greater than the axial height of each of the two successive grooves.

168. The unit of claim 158, wherein the at least one groove has a cross-section transverse to the plane in which it is oriented, the cross-section comprising one of a C-shape, a U-shape with a square bottom, a U-shape with a rounded bottom, and a V-shape.

169. The unit of claim 139, wherein the at least one second portion of the applicator member comprises at least one substantially axial slot.

170. The unit of claim 169, wherein the at least one substantially axial slot comprises a plurality of slots spaced laterally across the applicator member.

171. The unit of claim 170, wherein the slots are spaced apart substantially evenly.

172. The unit of claim 139, wherein the first portion of the applicator member comprises a first material and the second portion of the applicator member comprises a second material different from the first material.

173. The unit of claim 139, wherein the first portion of the applicator member comprises a first material and the second portion of the applicator member comprises a second material having a greater compressibility than the first material.

174. The unit of claim 139, wherein the at least one second portion of the applicator member comprises at least one of an open-cell foam and a semi-open-cell foam.

175. The unit of claim 174, wherein the at least one of an open-cell foam and a semi-open-cell foam comprises at least one of polyurethane, polyethylene, polyvinyl chloride, polyester, polyether, polyethylene-vinyl acetate, polyvinyl acetate foam, natural foam rubber, and synthetic foam rubber.

176. The unit of claim 139, wherein the at least one second portion of the applicator member comprises a spring.

177. The unit of claim 139, wherein the applicator member comprises a unitary part.

178. The unit of claim 177, wherein the unitary part is formed using at least one of machining and molding.

179. The unit of claim 139, wherein the at least one second portion of the applicator member defines a central cavity.

180. The unit of claim 139, wherein the application surface comprises at least one of a flat surface, a recessed surface, and a domed surface.

181. The unit of claim 139, wherein the application surface is oriented at least partially in a plane transverse to a longitudinal axis of the applicator member.

182. The unit of claim 181, wherein the plane is perpendicular to the longitudinal axis of the applicator member.

183. The unit of claim 181, wherein the plane is inclined with respect to the longitudinal axis of the applicator member.

184. The unit of claim 139, wherein an outer part of the applicator member comprises at least one of flocking, a woven fabric, a non-woven fabric, a porous film, and a non-porous film.

185. The unit of claim 139, wherein the application surface comprises at least one projection extending over at least a part of the application surface.

186. The unit of claim 185, wherein the at least one projection is chosen from pips, bosses, and inscriptions.

187. The unit of claim 139, wherein the applicator member is formed with a cross-section having a shape chosen from circular, oval, and polygonal.

188. The unit of claim 139, wherein the removable closure element comprises a skirt at least partially covering the second portion of the applicator member.

189. The unit of claim 139, wherein the first housing and the second housing are separated by an element permeable to the at least one product.

190. The unit of claim 189, wherein the element comprises at least one of a grating, a mesh, a one-way valve, a layer of foam, a woven fabric, and a non-woven fabric.

191. The unit of claim 142, wherein the at least one product comprises makeup.

192. The unit of claim 139, wherein the applicator member is configured so that the shape of the applicator member does not taper substantially from the at least one second portion to the application surface.

193. The unit of claim 156, wherein the at least one groove has a non-circular shape.

194. The unit of claim 166, wherein the applicator member comprises a first part between a first groove and a second groove and a second part between the second groove and a third groove, wherein a transverse dimension of the first part is substantially the same as a transverse dimension of the second part.

195. The unit of claim 194, wherein the first part and the second part have substantially the same diameter.

196. The unit of claim 139, wherein the applicator member comprises a first end portion secured to the removable closure element and a second end portion opposite to the first end portion, wherein the applicator member is configured so that a shape of the applicator member does not taper substantially from the first end portion to the second end portion.

197. The unit of claim 139, wherein the application surface comprises a substantially flat surface located at a free end portion of the applicator member.

198. The unit of claim 139, wherein the application surface comprises at least one concave curvature.

199. The unit of claim 139, wherein the at least one second portion of the applicator member is not substantially compressed when the applicator member is disposed in the second housing and the closure element seals the opening.

200. The unit of claim 139, wherein the at least one second portion of the applicator member is configured to flex during application of the at least one product.

201. The unit of claim 139, further comprising a body defining the first housing and the second housing.

202. The unit of claim 201, wherein the body comprises a single piece of material.

203. The unit of claim 139, wherein the unit is configured so that the applicator member is completely removable from the second housing.

204. A method of applying product, comprising:

providing the unit of claim 139;

transferring at least some of the at least one product from the first housing to the second housing;

loading the applicator member with product; and placing the application surface in contact with at least one of skin, hair, a finger nail, a toe nail, eyelashes, and eyebrows so as to apply product thereto.

205. The method of claim 204, wherein the product comprises at least one of lip make-up, foundation, blush, mascara, eye shadow, eye liner, and nail varnish.

206. The method of claim 204, wherein the product comprises at least one of a powder and a fluid.

207. The method of claim 204, wherein the product comprises at least one of cream, milk, gel, and a lotion.

208. The method of claim 207, wherein the placing causes a pressing force to be exerted on the application surface and wherein the method further comprises flexing the applicator member at least substantially at the at least one second portion of the applicator member.

* * * * *